United States Patent [19]

Trin

[11] Patent Number: 4,896,718

[45] Date of Patent: Jan. 30, 1990

[54] WATER RESERVOIR DEVICE CONTAINING AN OIL EXCHANGER, FOR AN AUTOMOBILE RADIATOR

[75] Inventor: Pierre Trin, Elancourt, France

[73] Assignee: Valeo, Paris, France

[21] Appl. No.: 190,453

[22] Filed: May 5, 1988

[30] Foreign Application Priority Data

May 6, 1987 [FR] France ..... 87 06416

[51] Int. Cl.[4] ..... F28D 7/10

[52] U.S. Cl. ..... 165/141; 165/154; 165/75; 165/76; 184/104.2; 184/104.3; 123/41.33

[58] Field of Search ..... 123/41.33; 184/104.2, 184/104.3; 165/140, 141, 154, 75, 76

[56] References Cited

U.S. PATENT DOCUMENTS

| | | | |
|---|---|---|---|
| 2,070,091 | 2/1937 | Nutt | 123/196 |
| 2,433,546 | 12/1947 | Cornelius | 165/134.1 |
| 3,612,174 | 10/1971 | Schaan | 165/154 |
| 3,732,921 | 5/1973 | Hilicki et al. | 165/154 |
| 3,831,671 | 8/1974 | Was | 165/154 |
| 3,831,672 | 8/1974 | Battisti | 165/154 |
| 3,983,932 | 10/1976 | Yamaguchi et al. | 165/154 |
| 4,006,775 | 2/1977 | Avrea | 165/51 |
| 4,086,959 | 5/1978 | Habdas | 165/155 |
| 4,665,972 | 5/1987 | Potier | 165/76 |
| 4,735,261 | 4/1988 | Huebner | 165/76 |

FOREIGN PATENT DOCUMENTS

| | | |
|---|---|---|
| 196257 | 3/1986 | . |
| 1162651 | 10/1956 | France . |
| 2278914 | 7/1983 | France . |
| 2548770 | 7/1983 | France . |
| 1567687 | 5/1980 | United Kingdom . |

OTHER PUBLICATIONS

Pat. Abstracts of Japan, vol. 10, No. 257, (M-513) (2313), Sep. 3, 1986: SP-A-61 83 434.

*Primary Examiner*—James C. Yeung

*Attorney, Agent, or Firm*—Dennison, Meserole, Pollack & Scheiner

[57] ABSTRACT

Water reservoir device for a radiator of an automobile, comprising a water reservoir (12) communicating with an external appended receptacle (14) which contains an oil exchanger (16), the inlet and discharge pipes (58) of this exchanger passing in a sealed manner through a wall (44) of the appended receptacle and serving for the fixation and maintenance of the oil exchanger in the appended receptacle.

17 Claims, 1 Drawing Sheet

WATER RESERVOIR DEVICE CONTAINING AN OIL EXCHANGER, FOR AN AUTOMOBILE RADIATOR

BACKGROUND OF THE INVENTION

The invention concerns a water reservoir device for an automobile radiator. The device contains an oil exchanger immersed in the coolant liquid circulating in the cooling radiator and is particularly applicable to the cooling of the lubricating oil of the engine and/or the transmission of automobiles.

Devices of this type, which are intended to cool the oil which circulates in the oil exchanger by means of a coolant liquid, are already known.

The oil exchanger of these known devices is placed in the water reservoir before the water reservoir is mounted on the end of a cluster of tubes or the body of an exchanger in the cooling radiator, the oil exchanger being introduced into the water reservoir through the open face of the reservoir which will then close the end of the body or of the cluster of tubes in the radiator.

The oil exchanger traditionally comprises two connection pipes which pass through one wall of the water reservoir by means of a sealed passage and which serve for the fixation and maintenance of the oil exchanger in the water reservoir. These pipes are intended to join the oil radiator to the oil lubrication circuit of the engine and/or the transmission, for instance an automatic transmission.

To allow for the mounting of the oil exchanger in the water reservoir, this water reservoir must be of a width which is essentially equal at least to the overall dimensions of the oil exchanger when in identical alignment, in other words generally speaking equal to the width of the oil exchanger with the addition of the length of the connector pipes.

Consequently, the water reservoir must be relatively wide, and generally speaking greater than the width or the corresponding dimension of the cluster of tubes or of the exchanger body of standard radiators.

That therefore leads to the requirement of using special water reservoirs, as well as collectors and special sealing joints, in place of the traditional water reservoirs, collectors and sealing joints, when it is desirable to place an oil exchanger inside a water reservoir.

SUMMARY OF THE INVENTION

The particular object of the invention is to overcome the aforementioned drawbacks.

Another object is to disclose a water reservoir device wherein the oil exchanger can be mounted in a particularly simple manner.

The invention concerns a water reservoir device for a radiator of an automobile in which an oil exchanger having two pipes, an inlet pipe and a discharge pipe, is immersed in the coolant liquid which circulates in the radiator.

According to one important characteristic of the invention, this device comprises an appended receptacle which communicates with the water reservoir and which also contains the oil exchanger, wherein the inlet and discharge pipes of this oil exchanger pass in a sealed manner through a wall of the appended receptacle and serve for the fixation and maintenance of the oil exchanger in the appended receptacle.

Thus in accordance with the invention, the water reservoir device is comprised of one part forming the water reservoir and one part forming the appended receptacle and containing the oil exchanger.

This particular characteristic of the device of the invention allows for use of the same collectors and the same sealed joints as in the case wherein the water reservoir is of the traditional type and does not contain any oil exchanger. Besides, this provision allows the use of the same oil radiators as those which were formerly mounted in the large water reservoirs.

According to another characteristic of the invention, the water reservoir and the appended receptacle form an assembly of one single block of material which can be molded of plastic material.

Preferably, the water reservoir and the appended receptacle are generally of oblong shape and are generally parallel to one another.

In the case wherein the water reservoir of the device has an open surface or face of rectangular shape which is of suitable dimensions to cap one end of the body or of the cluster of tubes of the radiator, the general alignment of the appended receptacle is then parallel to the two longer sides of the open face of the water reservoir.

In one preferred embodiment of the invention, the wall of the appended receptacle, which has the oil exchanger pipes passing through it, is generally cylindrical and includes one end closed by one bottom wall and another open end which may be closed by a cover, after placement of the oil exchanger in the appended receptacle.

In this case, the open end of the appended receptacle must have a width dimension which is greater than the dimensions, in the same alignment, of the oil exchanger and its pipes.

Thus, in accordance with the invention, it is the width dimension of the appended receptacle which must be adapted to the width dimensions of the oil radiator, the width of the water reservoir being adapted only to the thickness or the width of the cluster of tubes or of the body of the exchanger which makes up part of the radiator.

According to one other characteristic of the invention, the generally cylindrical wall of the appended receptacle is generally circular and also comprises a portion of flat wall which extends parallel to the axis of the cylinder and which includes two passage orifices for the two oil exchanger pipes.

By virtue of this characteristic, each pipe can comprise an annular flange applied on the internal surface of the aforementioned flat portion of the wall, and an end part with exterior threading which extends from the other side of the wall, through the passage orifice, and which receives a nut to tighten this portion of the flat wall on the annular flange.

According to still another characteristic of the invention, the water reservoir and the appended receptacle communicate with each other through two communication passages at some distance from each other.

The invention provides besides that these two passages for communication open respectively into two separate compartments of the water reservoir, which are separated by an internal partition within the water reservoir.

This allows the device according to the invention to be mounted on a radiator with either U or Z circulation.

In the following description, provided solely as an example, reference is made to the attached drawing.

DESCRIPTION OF THE PREFERRED EMBODIMENTS

Figure 1:
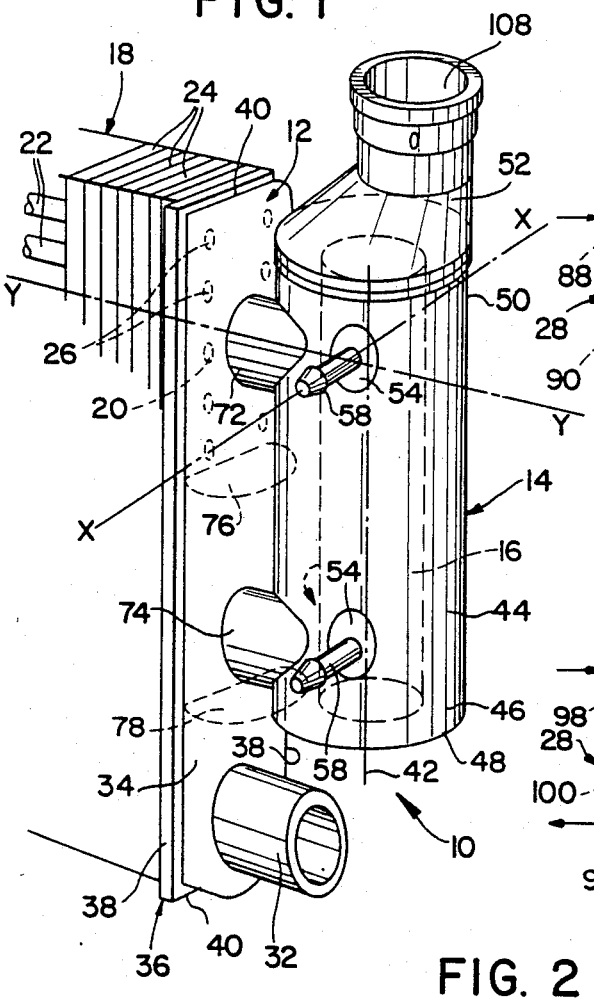
FIG. 1 shows a perspective view of a part of a cooling radiator equipped with a water reservoir device containing an oil radiator.
Figure 3:
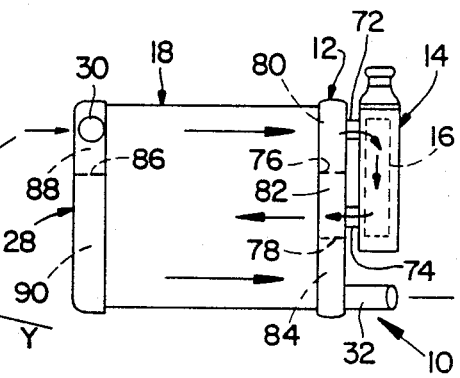
FIG. 3 shows an elevation of the radiator of FIG. 1, this radiator being of the Z-type circulation.
Figure 2:
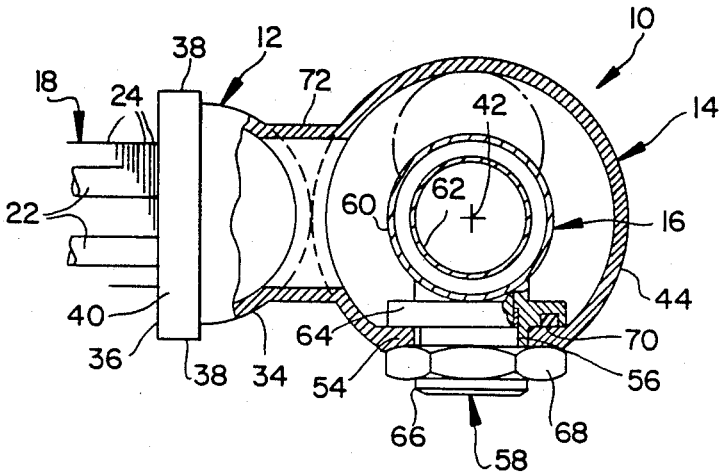
FIG. 2 shows a cross sectional view along a plane passing through the lines XX and YY of FIG. 1.

The first references will be to FIGS. 1 to 3 which represent a water reservoir device 10 according to the invention comprising a water reservoir 12 and an appended receptacle 14 which are in combination with each other, the appended receptacle containing an oil exchanger 16.

Water reservoir 12 is mounted in the traditional manner at one end of a cluster of tubes 18 by means of a collector or tubes plate 20 (FIG. 1). Cluster 18 in the traditional manner comprises an assembly of parallel tubes 22 which pass through an assembly of radiating flanges 24 which are parallel to each other and perpendicular to the lengthwise alignment of tubes 22. One end of each of tubes 22 is mounted in a sealed manner in holes 26 (FIG. 1) formed in the collector 20.

At the other end of cluster 18 is mounted a water reservoir 28 provided with an inlet pipe 30. Water reservoir 12 of device 10 is provided with a discharge pipe 32 (FIG. 3).

Water reservoir 12 includes a side wall 34 of semicircular upright cross section (FIG. 2) which is joined to a peripheral flange 36 which is rectangular, having two long sides 38 and two short sides 40. Flange 36 with lateral wall 34 thus defines an open surface of rectangular shape which is suitable to be joined in a sealed manner with collector 20, for instance by welding, if this collector and the water reservoir are formed of plastic material.

Appended receptacle 14 is of generally cylindrical shape of which the axis 42 (FIGS. 1 and 2) extends parallel to the two long sides 38 which are defining the open surface of water reservoir 12. Appended receptacle 14 presents a side cylindrical wall 44 of generally circular section of which the axis is 42. Wall 44 presents one closed end 46 closed by a bottom wall 48 and one open end 50 which may be closed by a cover 52, after oil exchanger 16 has been placed and positioned in appended receptacle 14.

Cylindrical wall 44 of appended receptacle 14 includes a flattened wall portion 54 which extends parallel to axis 42 of the cylinder and which includes two passage orifices 56 to receive the two pipes 58 for joining the oil exchanger to an oil circuit.

Oil exchanger 16 in a traditional manner comprises two coaxial cylindrical walls 60 and 62 (FIG. 2) sealed at their opposed axial ends. The two pipes 58 are arranged in the vicinity of these axial ends and open into the annular space located between cylindrical walls 60 and 62. Each of the pipes 58 is oriented perpendicular to the axis of oil exchanger 16, which, in the position shown in FIG. 2, is in alignment with axis 42 of appended receptacle 14. Each pipe 58 comprises an annular flange 64 engaged against the internal surface of the portion of flat wall 54 and one end part with exterior threading 66 which extends outward from the other side of the wall portion 54, through orifice 56, and which receives a nut 68 for tightening the annular flange 64 against wall portion 54 (FIG. 2). In addition, each annular flange 64 includes an annular groove which receives a sealing member 70 to assure the sealed passage of the two pipes 58 through wall 44 of appended receptacle 14.

The wall 44 of appended receptacle 14 and the open end 50 thereof present the same upright straight cross-section, providing a width dimension greater than the dimensions, in the same direction, of oil exchanger 16 and its pipes 58. This allows for the simple mounting of oil exchanger 16 inside appended receptacle 14 by sliding the oil exchanger and its pipes longitudinally into the receptacle 14. For that purpose, it suffices to introduce exchanger 16 axially into appended receptacle 14 so that the cylindrical wall 60 of the receptacle 14 is in the position shown in broken lines in FIG. 2, and the pipes 58 are oriented perpendicular to the flat wall portion 54. When these two pipes are facing the two corresponding orifices 56, then it suffices to displace exchanger 16 so that the two pipes 58 pass through the two corresponding orifices 56, and then to place and position the two nuts 68.

Water reservoir 12 and appended receptacle 14 form an assembly made of one integral piece, which may be of a molded plastic material. Two parallel cylindrical conduits 72 and 74 both connect lateral wall 34 of the water reservoir and wall 44 of appended receptacle 14. These two cylindrical conduits are also formed integral with the water reservoir and the appended receptacle and the conduits extend parallel to each other and perpendicular to the open surface of water reservoir 12 and perpendicular to axis 42 of appended receptacle 14. Cylindrical conduits 72 and 74 thus define two communication passages between the inside of water reservoir 12 and the inside of appended receptacle 14.

In the embodiment of FIGS. 1 to 3, water reservoir 12 comprises two internal partitions 76 and 78 which subdivide the interior of water reservoir 12 into three compartments 80, 82 and 84. Compartment 80 communicates with appended receptacle 14 through cylindrical conduit 72. Compartment 82 communicates with appended receptacle 14 through cylindrical conduit 74. Compartment 84 is in communication with discharge pipe 32 from water reservoir 12.

In addition, as shown in FIG. 3, water reservoir 28 comprises an internal partition 86 which separates this water reservoir into a compartment 88 communicating with inlet conduit 30 and another compartment 90.

The cooling radiator shown in FIG. 3 functions in the following manner. The coolant liquid, for instance a mixture of water and glycol, enters the radiator through inlet pipe 30 and thus passes into compartment 88. From there, it flows through one part of the tubes of the cluster in order to reach compartment 80, to pass through conduit 72 and enter into the interior of the appended receptacle in order to cool the oil which flows through oil exchanger 16. The coolant liquid then leaves appended receptacle 14 by passing through conduit 74 to reach compartment 82. From there, it flows through another part of the tubes of the cluster in order to reach compartment 90. Then it leaves compartment 90, passes through another part of the tubes of the cluster, reaches compartment 84 and is discharged from water reservoir 12 through pipe 32. The circulation of the coolant in this radiator is carried out in a Z-shaped circulation, forming a "triple circuit".

Figure 4:
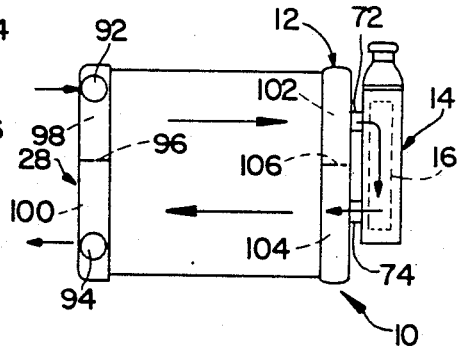
FIG. 4 shows an elevation of a radiator with U-type circulation and equipped with a water reservoir device according to the invention.

Now reference is made to FIG. 4. In this embodiment, water reservoir 28 comprises an inlet nipple 92 and a discharge nipple 94. An internal partition 96 subdivides the water reservoir into two compartments 98 and 100 which communicate respectively with pipes 92 and 94.

Water reservoir 12 is subdivided into two compartments 102 and 104 by a partition 106. Appended receptacle 14 thus communicates with compartment 102 through conduit 72 and with compartment 104 through conduit 74. The radiator of FIG. 4 functions as follows. The coolant reaches compartment 98 through pipe 92, passes through a part of the tubes of cluster 18, reaches compartment 102 and then passes into appended receptacle 14 through conduit 72. In this receptacle, it cools the oil which circulates in exchanger 16. The coolant then leaves the appended receptacle by passing successively through conduit 74, into compartment 104, and through the other part of the tubes of cluster 18 to reach compartment 100, which it leaves through pipe 94. The cooling circuit is thus of the type called a "bi-circuit" or U-shaped circuit.

In the two aforementioned embodiments, the cover 52 is affixed with a seal on the open end 50 of appended receptacle 14 for instance by welding or even by using a clamping ring. Cover 52 may be a simple plug or else, as shown in FIG. 1, may constitute a filling coupling, having its own cap 108, thus allowing filling of the radiator with coolant liquid directly through appended receptacle 14.

The water reservoir device of the invention offers the supplementary advantages of allowing that the oil exchanger be mounted in the appended receptacle either before final assembly, or following mounting of the water reservoir on the tube cluster.

Besides, taking into consideration the cylindrical shape of the appended receptacle, the water reservoir device is adequately resistant to the pressure of the coolant liquid.

Nonetheless, any desired shape of the appended receptacle may be considered, such as for instance a circular shape limited by a flat wall parallel to the open edge of the water reservoir and situated beyond the oil radiator. The lengthwise dimensions of the exchanger can be limited in this manner.

What is claimed is:

1. A water reservoir device for an automobile radiator with a tube body, said device comprising a water reservoir (12), an appended receptacle (14) exterior of and in communication with the water reservoir (12), said receptacle including completely encircling peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said water reservoir (12) and the appended receptacle (14) comprising an integral molded assembly of plastic material.

2. Device as in claim 1, wherein the water reservoir (12) and the appended receptacle (14) are of generally oblong shape and are generally lengthwise parallel to each other.

3. A water reservoir device for an automobile radiator with a tube body, said device comprising a water reservoir (12), an appended receptacle (14) exterior of and in communication with the water reservoir (12), said receptacle including completely encircling peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said water reservoir (12) and the appended receptacle (14) being of generally oblong shape and being generally lengthwise parallel to each other, said water reservoir (12) presenting an open face of oblong rectangular shape which is suitable to cap one end of the tube body of the radiator, wherein the appended receptacle (14) is outwardly spaced from the water reservoir (12) and is parallel to the two longer sides (38) of the open face of the water reservoir (12).

4. A water reservoir device for an automobile radiator with a tube body, said device comprising a water reservoir (12), an appended receptacle (14) exterior of and in communication with the water reservoir (12), said receptacle including peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said water reservoir (12) and the appended receptacle (14) being of generally oblong shape and generally lengthwise parallel to each other, said water reservoir (12) presenting an open face of oblong rectangular shape which is suitable to cap one end of the tube body of the radiator, the appended receptacle (14) being parallel to the two longer sides (38) of the open face of the water reservoir (12), said wall means of the appended receptacle (14), being generally cylindrical and including one end (46) closed by a wall (48) and a second end (50) open, and a cover (52) for closing the second end after placement and positioning of the oil exchanger (16) in the appended receptacle (14).

5. Device as in claim 4, wherein the open end (50) of the appended receptacle has a width dimension greater than the overall dimensions, in the same direction, of the oil exchanger (16) and its pipes (58).

6. Device as in claim 5, wherein the generally cylindrical wall means of the appended receptacle (14) is generally of circular section and comprises a flat wall portion (54) which extends parallel to the axis (42) of the generally cylindrical wall means, and two passage orifices (56) through said flat wall portion to receive the inlet and discharge pipes (58) of the oil exchanger (16).

7. Device as in claim 6, wherein the water reservoir (12) and the appended receptacle (14) communicate with one another by means of two communication passages which are at some distance from each other.

8. Device as in claim 7, wherein the two communication passages are formed by two parallel cylindrical conduits (72, 74) connecting the water reservoir (12) to the wall means of the appended receptacle (14).

9. Device as in claim 8, wherein the water reservoir includes two separate compartments separated by an internal partition, the two communication passages opening respectively into the two separate compartments of the water reservoir.

10. Device as in claim 4, wherein the cover (52) forms a filling coupling for filling the radiator.

11. Device as in claim 4, wherein the water reservoir (12) and the appended receptacle (14) comprise an integral molded assembly of plastic material.

12. A water reservoir device for an automobile radiator with a tube body, said device comprising a water reservoir (12), an appended receptacle (14) exterior of and in communication with the water reservoir (12), said receptacle including peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said water reservoir (12) and the appended receptacle (14) being of generally oblong shape and being generally lenghtwise parallel to each other, said wall means of the appended receptacle (14), being generally cylindrical and including one end (46) closed by a wall (48) and a second end (50) open, and a cover (52) for closing the second end after placement and positioning of the oil exchanger (16) in the appended receptacle (14).

13. Device as in claim 12, wherein the open end (50) of the appended receptacle has a width dimension greater than the overall dimensions, in the same direction, of the oil exchanger (16) and its pipes (58).

14. A water reservoir device for an automobile radiator with a tube body, said device comprising a single water reservoir (12) mounted to and in fluid passing communication with one end of the tube body, an appended receptacle (14) exterior of and in communication with the water reservoir (12), said receptacle including completely encircling peripheral wall means, and an oil exchanger (16) received within said receptacle, said oil exchanger including inlet and discharge pipes (58) passing in an sealed manner through the wall means of the appended receptacle (14), for communication with an oil circuit, and means on said pipes for mounting the oil exchanger (16) in the appended receptacle (14), and two spaced communication passages, each extending directly between and communicating said single water reservoir (12) and the appended receptacle (14) with one another, whereby fluid flow to and from said receptacle is effected solely with said single water reservoir.

15. A water reservoir device for an automobile radiator with a tube body, said device comprising a water reservoir (12), an appended receptacle (14) exterior of and in communication with the water reservoir (12), said receptacle including peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said water reservoir (12) and the appended receptacle (14) communicating with on another by means of two communication passages which are at some distance from each other, said two communication passages being formed by two parallel cylindrical conduits (72, 74) connecting the water reservoir (12) to the wall means of the appended receptacle (14).

16. Device as in claim 15, wherein the water reservoir includes two separate compartments separated by an internal partition, the two communication passages opening respectively into the two separate compartments of the water reservoir.

17. A water reservoir device for an automobile radiator with a tube body, said device comprising a water reservoir (12), an appended receptacle (14) exterior of and in communication with the water reservoir (12), said receptacle including completely encircling peripheral wall means, and an oil exchanger (16) received within said receptacle, said oil exchanger including inlet and discharge pipes (58) passing in a sealed manner through the wall means of the appended receptacle (14), for communication with an oil circuit, and means on said pipes for mounting the oil exchanger (16) in the appended receptacle (14), said appended receptacle (14) including means for introducing said oil exchanger therein independently of said water reservoir (12).

* * * * *